US006401623B2

(12) United States Patent
Sartori

(10) Patent No.: US 6,401,623 B2
(45) Date of Patent: Jun. 11, 2002

(54) RAILROAD TRACK BALLAST TAMPER

(75) Inventor: Sandri Sartori, Wintzenheim (FR)

(73) Assignee: Societe des Anciens Establissements Lucien Geismer, Neuilly sur Siene (FR)

( * ) Notice: Subject to any disclaimer, the term of this patent is extended or adjusted under 35 U.S.C. 154(b) by 0 days.

(21) Appl. No.: 09/791,637

(22) Filed: Feb. 26, 2001

(30) Foreign Application Priority Data

Feb. 29, 2000 (FR) ..... 00-02571

(51) Int. Cl.[7] ..... E01B 27/00
(52) U.S. Cl. ..... 104/12
(58) Field of Search ..... 104/10, 12, 2, 104/7.1

(56) References Cited

U.S. PATENT DOCUMENTS 4,130,063 A * 12/1978 Theurer et al. ..... 104/12
4,488,492 A * 12/1984 Ganz ..... 104/12
4,563,953 A * 1/1986 Theurer ..... 104/12
4,744,304 A * 5/1988 Pasquini ..... 104/12
4,773,333 A * 9/1988 Theurer ..... 104/12
4,843,967 A * 7/1989 Whitaker ..... 104/12
4,913,058 A * 4/1990 Mancini ..... 104/12
4,942,821 A * 7/1990 Rossanigo ..... 104/12
4,986,189 A * 1/1991 Theurer et al. ..... 104/12

* cited by examiner

*Primary Examiner*—Mark T. Le
(74) *Attorney, Agent, or Firm*—Oliff & Berridge, PLC

(57) ABSTRACT

The ballast tamper comprises two tool holders articulated to a chassis and equipped with tools set in vibration and fitting one on each side of a single or double cross tie of the track. The tops of the tool holders are connected by a hydraulic gripper ram. The supply of hydraulic fluid to the ram, for at least one of its directions of travel, is provided by an external hydraulic assembly which comprises means for metering an amount of fluid let into the ram or discharged therefrom so as to cause the rod of this ram to selectively describe a limited gripper opening stroke, in the case of a single cross tie, or a full stroke, in the case of a double cross tie. A particularly quiet "hydraulic stop" effect is thus achieved.

10 Claims, 3 Drawing Sheets

RAILROAD TRACK BALLAST TAMPER

BACKGROUND OF THE INVENTION

The present invention relates to a railroad track ballast tamper of the forced vibration type.

DESCRIPTION OF THE PRIOR ART

In the field of railroads, it is necessary to consolidate the tracks by packing the cross ties using a method known as tamping. This consists in packing the ballast under the cross ties using devices known as tampers which are, in fact, vibrating grippers. These are forced into the ballast, on each side of a cross tie, causing the latter to vibrate at a given frequency close to the natural frequency of the ballast, and imparting to the gripper a closure movement which forces the ballast in under the cross tie.

FIG. 1 of the appended schematic drawing shows a current design of tamper. This comprises a chassis 1 equipped with vertical suspension elements 2 and 3 and two tool holders 4 and 5 articulated symmetrically to the chassis 1 about two respective parallel and horizontal axles 6 and 7, in the manner of levers. In their upper parts, the two tool holders 4 and 5 are equipped respectively with tools 8 and 9 known as "packers", which fit on each side of a cross tie 10 of the track. A device involving an eccentric 11, carried by the central part of the chassis 1, causes the tools 8 and 9 to vibrate.

The respective upper ends of the two tool holders 4 and 5 are connected by a roughly horizontal hydraulic gripper ram 12, the body 13 of the ram 12 being, for example, connected by an articulation 14 to the first tool holder 4, while the rod 15 of this ram 12 is connected by an articulation 16 to the second tool holder 5.

An auxiliary hydraulic ram 17 is currently associated with the hydraulic gripper ram 12 and, in combination with a pivoting rider 18, acts as a mechanical stroke limiter for the gripper ram 12, as depicted more particularly in FIGS. 2 and 3. The auxiliary ram 17 is articulated by its body, about an axle 19, to the body 13 of the gripper ram 12, toward one end of this body 13. The rod of the auxiliary ram 17 is articulated, about an axle 20, on the rider 18 which is itself mounted so that it can pivot about an axle 21 on the body 13 of the gripper ram 12, toward the other end of this body 13.

In a first position illustrated in FIG. 2, the auxiliary ram 17 (the rod of which is deployed) brings the rider 18 into direct abutment on the front face of the body 13 of the gripper ram 12, by pivoting about the axle 21. The rider 18 thus positioned constitutes a blocking wedge which limits the opening stroke of the gripper ram 12 to a value C1, by a mechanical stop effect. This first position, in which the opening gripper stroke of the vibrating gripper is limited, is suitable for the use of the tamper with a single cross tie 10.

To deal with a double cross tie, formed of two cross ties back to back, as encountered in particular where rails join, the auxiliary ram 17 is actuated in the direction of retraction of its rod so as to cause the rider 18 to pivot about the axle 21 in the direction of its retraction—see FIG. 3. The rod 15 of the gripper ram 12 can therefore describe its maximum stroke C2 until this rod 15 is fully retracted into the body 13 of the gripper ram 12. Thus the gripper opening stroke is no longer limited and the packers 8 and 9 can be parted more widely so as to grip a double cross tie.

This mechanical stop device causes jolts and noise which, added to the vibration needed for actual tamping and amplified by this vibration, gives rise to a high noise level when the tamper is in operation. This high level of noise is a nuisance not only to the operators, but also to the neighborhood, particularly when the work is carried out at night.

More particularly, the current device for mechanically limiting the stroke of the gripper ram 12 gives rise to mechanical jolts throughout the vibration phase. The mechanical jolts, which are already in themselves noisy, are amplified by the excitation, at the vibrating frequency of the tamper, of the play in the articulation along the three axles 19, 20 and 21 of the assembly made up of the ram 17 and of the rider 18. This phenomenon considerably increases the amount of noise generated by the tamper.

SUMMARY OF THE INVENTION

An object of the present invention is to eliminate the jolts, parasitic vibration and noise generated by the device for mechanically limiting the opening stroke of the gripper ram in such a way as to reduce the total level or acoustic emissions of the tamper so as to bring these emissions down to a level that is more acceptable to operators and to the neighborhood.

To this end, a subject of the invention is essentially a ballast tamper of the type involved here, that is to say comprising two tool holders, articulated to a chassis about parallel horizontal axles, which are equipped in their lower parts with tools capable of fitting one on each side of a single or double cross tie of the track concerned, and the upper ends of which are connected by a hydraulic gripper ram, means being provided for vibrating the tools, this ballast tamper being characterized in that the supply of hydraulic fluid or the draining of hydraulic fluid from the hydraulic gripper ram, for at least one of its two directions of travel, is provided by a hydraulic assembly external to this ram and comprising means for metering an amount of hydraulic fluid capable of being let into said ram or discharged therefrom so as to cause the rod of this ram to describe a gripper opening stroke limited to a value below that of its full stroke, the hydraulic assembly also comprising hydraulic control means associated with said metering means.

In one embodiment of the invention, the means for metering the amount of hydraulic fluid let into the gripper ram or discharged therefrom consist of a metering ram, the piston of which can be moved hydraulically over a controlled stroke, it being possible to place said metering ram in communication with the gripper ram so as to allow a predetermined amount of hydraulic fluid to be let into or drained from this gripper ram.

Thus, the inventive step consists in replacing the current mechanical stop device that limits the opening stroke of the gripper ram with an assembly which produces a kind of "hydraulic stop" effect, by metering the amount of oil used in the gripper ram. By virtue of appropriate control means, this ram can be supplied with or drained of hydraulic fluid either directly, in which case it will effect its full opening stroke, designed for use of the tamper with double cross ties, or indirectly with the intervention of the metering ram, in which case the gripper ram describes a limited opening stroke designed for use with single cross ties.

Thus, the mechanical elements located on the tamper and which generate jolts and noise, namely the pivoting rider and its actuating ram, are dispensed with entirely, thus definitively eliminating the noises emitted by these elements and by their articulations In addition, the elimination of these mechanical components simplifies the structure and the kinetics of the tamper.

As a preference, the hydraulic assembly including the metering means such as the metering ram and the hydraulic control means associated with said metering means is located some distance away from the hydraulic ram in a fixed, non-vibrating part of the machine. The metering ram, which is therefore located at a stable point, generates no mechanical noise. All of this plays a part in reducing the acoustic nuisance.

As for the hydraulic control means associated with the metering means such as the metering ram, these can be produced in a simple way using a set of directional-control valves, particularly electrically-operated directional-control valves designed to selectively direct the hydraulic fluid directly to the gripper ram or to the metering means or to selectively drain the gripper ram directly to the source of fluid or to the metering means.

BRIEF DESCRIPTION OF THE DRAWINGS

In any event, the invention will be better understood with the aid of the description which follows, with reference to the appended schematic drawing which, by way of example, depicts one embodiment of this ballast tamper:

FIGS. 4 and 6 depict a ballast tamper according to the present invention, re-using, in the case of elements which are common, the same numerical references as those or FIGS. 1 to 3.

DESCRIPTION OF THE PREFERRED EMBODIMENT

Figure 1:
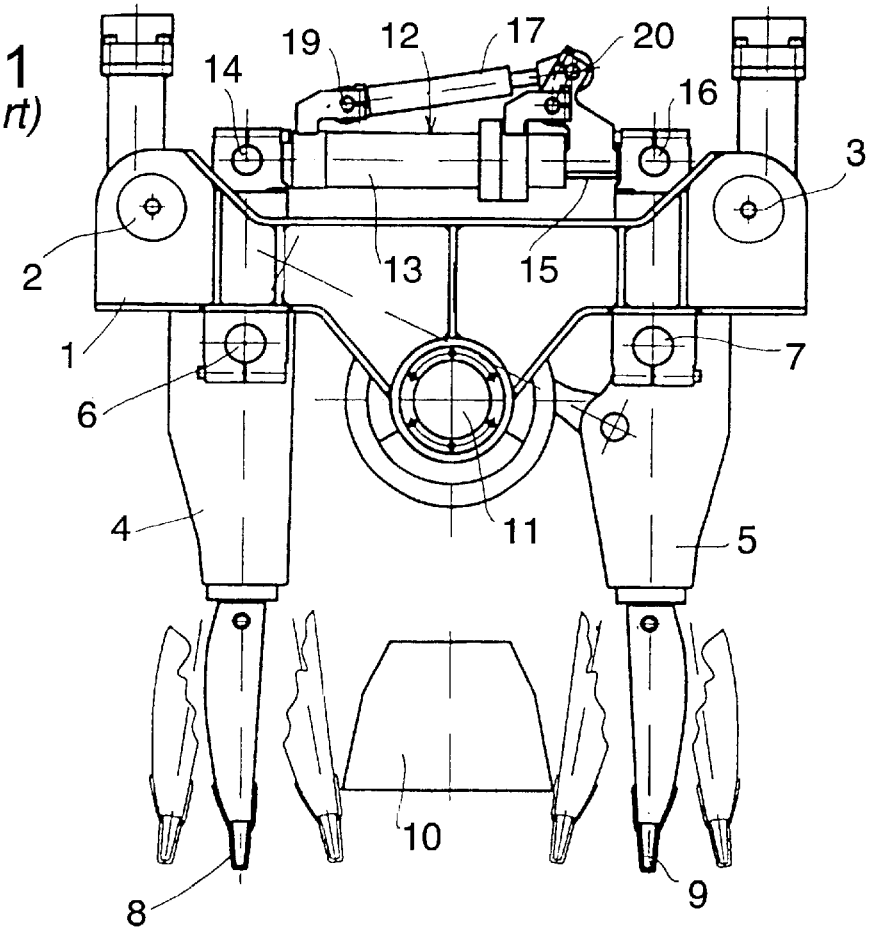
FIG. 1 (Prior Art)
FIG. 1 (already mentioned) is an overall front view of a tamper of the prior art.
Figure 2:
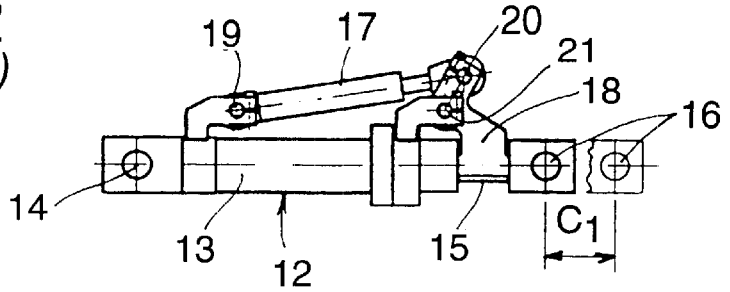
FIG. 2 (Prior Art)
FIG. 2 (already mentioned) shows the gripper ram and the associated mechanical stop device belonging to the tamper of FIG. 1, in a position in which it limits the gripper opening stroke.
Figure 3:
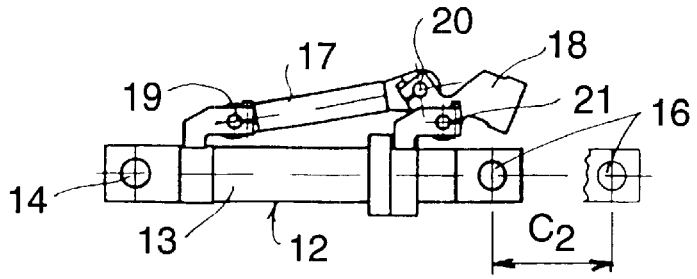
FIG. 3 (Prior Art)
FIG. 3 is a view similar to FIG. 2, but illustrating the full opening stroke position of the tamper of FIG. 1.
Figure 4:
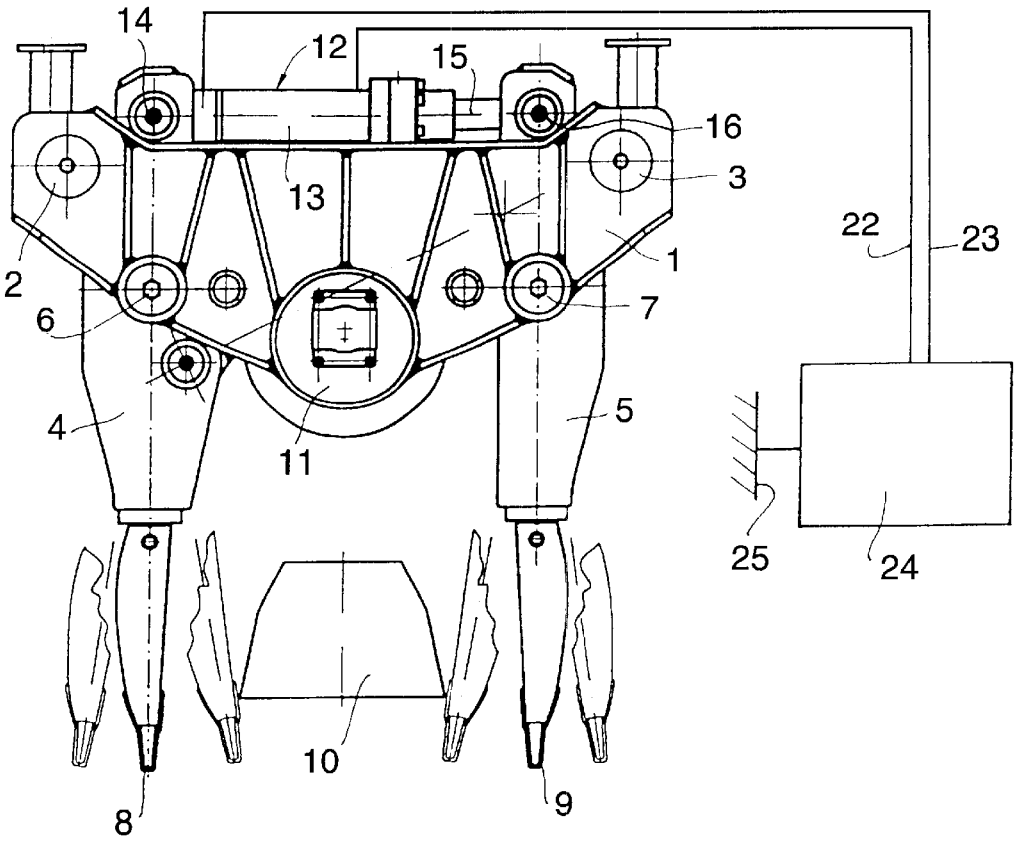
FIG. 4 is an overall front view of a tamper according to the present invention.

Thus, this tamper also comprises a chassis 1 equipped with suspension elements 2 and 3 and two tool holders 4 and 5 articulated symmetrical to the chassis 1 about two respective parallel and horizontal axles 6 and 7. At their lower parts, the two tool holders 4 and 5 are equipped with tools or "packers" 8 and 9, these being vibrated by a device involving an eccentric 11 carried by the central part of the chassis 1.

The respective upper ends of the two tool holders 4 and 5 are, here again, connected by a roughly horizontal hydraulic gripper ram 12. The body 13 of the gripper ram 12 is connected by an articulation 14 to the top of the first tool holder 4, while the rod 15 of this ram 12 is connected by an articulation 16 to the top of the second tool holder 5.

There is no auxiliary ram and no pivoting rider associated here with the hydraulic gripper ram 12. The gripper ram 12 is connected, by hydraulic lines 22 and 23, to an external hydraulic assembly denoted overall by the reference 24, this hydraulic assembly 24 being mounted on a stable and non-vibrating fixed part, labeled 25, of the machine.

Figure 5:
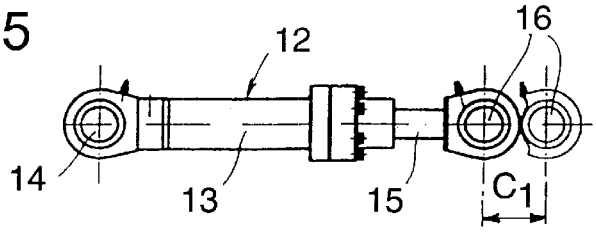
FIG. 5 shows the gripper ram of the tamper according to the invention, in the position for limiting the gripper opening stroke.
Figure 6:
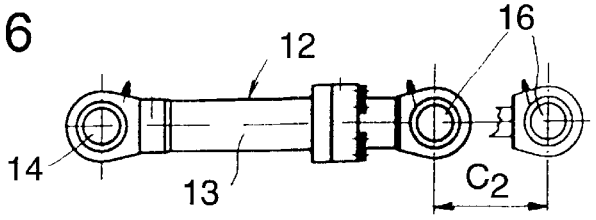
FIG. 6 shows the gripper ram of the tamper according to the invention, in the full opening stroke position.

The hydraulic assembly 24 itself, aside from performing the general function of supplying the gripper ram 12 with hydraulic fluid, also carries out the special function of limiting the opening stroke of the gripper ram 12, that is to say it selectively obtains a reduced stroke C1 (see FIG. 5) for using the tamper with a single cross tie 101 and a full stroke C2 (see FIG. 6) for using the same tamper with a double cross tie.

Figure 7:
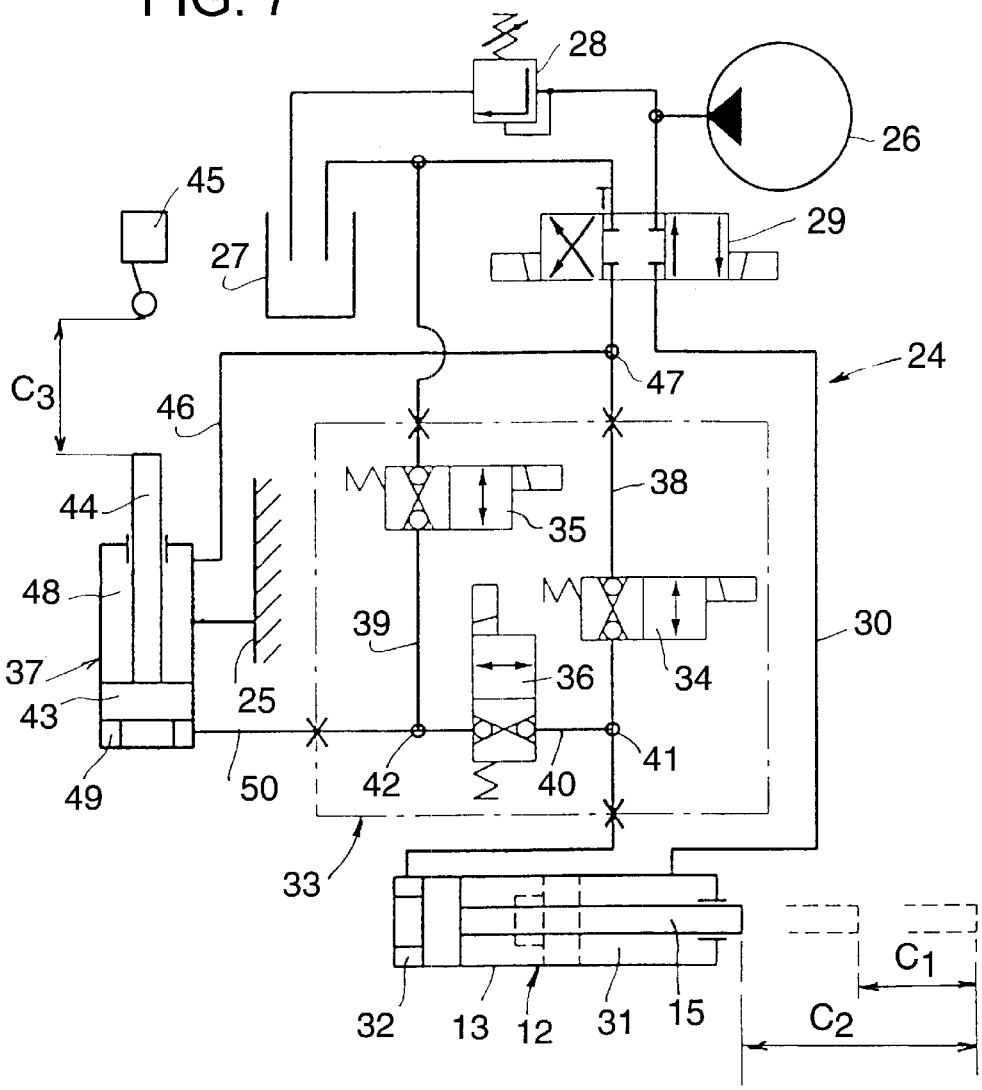
FIG. 7 is a hydraulic diagram of the ballast tamper according to the invention.

To do this, the hydraulic assembly 24 has a particular configuration, shown in the form of a hydraulic diagram in FIG. 7.

In a way which is generally known, the hydraulic assembly 24 comprises a pump 26, an oil reservoir 27, a pressure limiter 28, and a main directional-control valve 29, particularly in the form of an electrically-operated directional-control valve.

One branch 30 of the hydraulic circuit, departing from the main directional-control valve 29, is connected directly to one of the two chambers 31 of the gripper ram 12.

Another part of the hydraulic circuit is connected to the second chamber 32 of the gripper ram 12 via a specific directional-control unit 33 which comprises three electrically-operated directional-control valves 34, 35 and 36. This part of the hydraulic circuit is also connected to a metering ram 37 mounted directly on the fixed part 25 of the machine.

More specifically, the first electrically-operated directional-control valve 34 of the unit 33 is inserted on a branch 38 of the hydraulic circuit, departing from the main directional-control valve 29 and leading to the second chamber 32 of the gripper ram 12. The second electrically-operated directional-control valve 35 is inserted on a branch 39 of the hydraulic circuit returning to the oil reservoir 27. The third electrically-operated directional-control valve 36 is inserted on a branch 40 of the hydraulic circuit inside the unit 33 and connecting an intermediate point 41 or the branch 39 of the circuit, located between the first electrically-operated directional-control valve 34 and the ram 12, to the starting point 42 of the branch 39 of the circuit returning to the reservoir 27.

The metering ram 37 comprises a cylindrical body in which is slidably mounted a piston 43 secured to a rod 44, the outer end of which collaborates with an end-of-travel contact 45.

One branch 46 of the hydraulic circuit, having its starting point 47 on the branch 38 between the main directional-control valve 29 and the first electrically-operated directional-control valve 34, ends at one of the chambers 48 of the metering ram 37. The other chamber 49 of this metering ram 37 is connected, by a last branch 50 of the circuit, to the starting point 42 of the branch 39 of the circuit returning to the reservoir 37, and therefore also to the branch 40 of the circuit in which the third electrically-operated directional-control valve 36 is inserted.

The way in which the hydraulic assembly 24 works is as follows:

In order to cause the rod 15 of the gripper ram 12 to deploy, with its full stroke C2, the main directional-control valve 29 is placed in its position which allows pressurized oil to pass from the pump 26 to the branch 38 of the circuit in which the first electrically-operated directional control-valve 34 is inserted, the latter being brought into the open position to cause the rod 15 of the gripper ram 12 to deploy.

At the same time, pressurized oil is let, via the branch 46 of the circuit, into the chamber 48 of the metering ram 37, the other chamber 49 of which is therefore drained via the branches 50 and 39 of the circuit, the second electrically-operated directional-control valve 35 being open.

To cause the rod 15 of the gripper ram 12 to retract, with the reduced stroke C1, the main directional-control valve 29 is switched to its other position, allowing the pressurized oil to pass from the pump 26 to the branch 30 of the circuit leading directly to the chamber 31 of the gripper ram 12.

At the same time, in the directional-control unit 33, only the third electrically-operated directional-control valve 36 is open. The oil drained from the other chamber 32 of the gripper ram 12 is thus transferred, by the branches 40 and 50 of the circuit, into the chamber 49 of the metering ram 37, the piston 43 of which is shifted (upward with reference to FIG. 7) until the rod 44 actuates the end-of-travel contact 45. The travel C3 of the rod 44 is therefore interrupted, the two electrically-operated directional-control valves 36 and 29 being closed again; this travel C3 is "metered" in such a way that, at the moment of closure of the electrically-operated directional-control valves 36 and 29, the draining of the second chamber 32 of the gripper ram 12 is partial, and corresponds to the desired reduced stroke C1 of the gripper ram 12.

To cause the rod 15 of that same gripper ram 12 to retract, with the stroke C2, the directional-control valve 29 is brought into the same position as before, but, in the directional-control unit 33, only the first electrically-operated directional-control valve 34 is open. Thus, the metering ram 37 is no longer involved, and the chamber 32 of the gripper ram 12 is drained completely and directly by the branch 38 of the circuit.

As goes without saying, the invention is not restricted to the single embodiment of this ballast tamper which has been described hereinabove by way of example; on the contrary, it encompasses all alternative embodiments and applications thereof that observe the same principle. In particular, it would not constitute a departure from the scope of the invention if the details of the hydraulic circuit were to be modified, provided that the circuit fulfilled the same functions, or if the structure of the metering ram were to be modified, for example by producing this ram with a "floating" rodless piston and with a different end-of-travel detection system (for example a magnetic one), or even if the metering ram were to be replaced by any equivalent hydraulic means, particularly of the "hydraulic" accumulator kind.

What is claimed is:

1. A railroad ballast tamper comprising:

first and second tool holders pivotally connected to a chassis about parallel horizontal axles, the tool holders equipped at their respective lower ends with tool capable of fitting on each side of a single or double cross tie, and connected at their upper ends by a hydraulic gripper ram;

tool vibrating means for vibrating the tools; and a hydraulic fluid control assembly, providing external to the hydraulic gripper ram, comprising a hydraulic fluid source, means for metering an amount of hydraulic fluid provided to the gripper ram or discharged therefrom so as to incrementally control the stroke of the hydraulic gripper ram to a value below that of its full stroke, and hydraulic control means for controlling the movement of hydraulic fluid, wherein the hydraulic control means is associated with the metering means.

2. The ballast tamper as claimed in claim 1, wherein the metering means includes a metering ram having a piston that is moved hydraulically over a controlled stroke, and communicates with the gripper ram so as to allow a predetermined amount of hydraulic fluid to be provided to or drained from the gripper ram.

3. The ballast tamper as claimed in claim 2, wherein the piston of the metering ram is secured to a rod that collaborates with an end-of-travel contact, the controlled stroke of the rod corresponding to a reduced stroke of the gripper ram.

4. The ballast tamper as claimed in claim 1, wherein the hydraulic fluid control assembly further comprises a set of directional-control valves, particularly electrically-operated directional-control valves, designed to selectively direct the hydraulic fluid directly to the gripper ram or to the metering means or to selectively drain the gripper ram directly to the hydraulic fluid source or to the metering means.

5. The ballast tamper as claimed in claim 1, wherein the hydraulic fluid control assembly is located remotely from the gripper ram, tool holders and tool vibrating means.

6. The ballast tamper as claimed in claim 2, wherein the hydraulic control means, associated with the metering means further comprises a set of directional-control valves, particularly electrically-operated directional-control valves, designed to selectively direct the hydraulic fluid directly to the gripper ram or to the metering means or to selectively drain the gripper ram directly to the hydraulic fluid source or to the metering means.

7. The ballast tamper as claimed in claim 3, wherein the hydraulic control means associated with the metering means further comprises of a set of directional-control valves, particularly electrically-operated directional-control valves, designed to selectively direct the hydraulic fluid directly to the gripper ram or to the metering means or to selectively drain the gripper ram directly to the hydraulic fluid source or to the metering means.

8. The ballast tamper as claimed in claim 2, wherein the hydraulic fluid control assembly, including the metering means, and the hydraulic control means associated with said metering means, is located remotely from the gripper ram, tool holders and tool vibrating means.

9. The ballast tamper as claimed in claim 3, wherein the hydraulic fluid control assembly, including the metering means, and the hydraulic control means associated with said metering means, is located remotely from the gripper ram, tool holders and tool vibrating means.

10. The ballast tamper as claimed in claim 4, wherein the hydraulic fluid control assembly, including the metering means, and the hydraulic control means associated with said metering means, is located remotely from the gripper ram, tool holders and tool vibrating means.

* * * * *